US008251244B2

(12) United States Patent
Henf et al.

(10) Patent No.: US 8,251,244 B2
(45) Date of Patent: Aug. 28, 2012

(54) RESPIRATOR

(75) Inventors: Dirk Henf, Lübeck-Travemünde (DE); Christian Wilhelm, Lübeck (DE)

(73) Assignee: Dräger Safety AG & Co. KGaA, Lübeck (DE)

( * ) Notice: Subject to any disclaimer, the term of this patent is extended or adjusted under 35 U.S.C. 154(b) by 1292 days.

(21) Appl. No.: 11/955,590

(22) Filed: Dec. 13, 2007

(65) Prior Publication Data

US 2008/0142516 A1 Jun. 19, 2008

(30) Foreign Application Priority Data

Dec. 15, 2006 (DE) ..... 10 2006 059 339
Aug. 16, 2007 (DE) ..... 10 2007 038 598

(51) Int. Cl.
*B65D 45/16* (2006.01)

(52) U.S. Cl. ..... 220/324; 24/193

(58) Field of Classification Search ..... 220/212, 220/200, 243, 322, 324, 315; 190/119, 121, 190/122, 114, 118; 24/265 AL, 265 CD, 24/193, 200, 17 B, 170; 292/325, 32, 41, 292/42, 246–248, 137, 162, 145, DIG. 4, 292/DIG. 11, DIG. 48; 128/201.25, 205.27, 128/205.28, 205.29, 206.16, 206.17
See application file for complete search history.

(56) References Cited

U.S. PATENT DOCUMENTS 1,032,047 A * 7/1912 Curd ..... 24/167
2,746,116 A * 5/1956 Craven ..... 24/265 AL
3,057,029 A * 10/1962 Miller, Jr. ..... 24/712.6
3,065,513 A * 11/1962 Warner et al. ..... 24/265 AL
3,206,816 A * 9/1965 Vilcins et al. ..... 24/200
3,414,943 A * 12/1968 Hattori ..... 24/200
3,583,045 A * 6/1971 Coyle ..... 24/265 AL
3,686,715 A * 8/1972 Brodnicki ..... 24/68 CD
3,914,831 A * 10/1975 Steinberg ..... 24/265 AL
3,967,347 A * 7/1976 Bickis, Sr. ..... 24/200
3,969,792 A * 7/1976 Hattori ..... 24/200
4,017,946 A * 4/1977 Soja ..... 24/265 AL
4,117,573 A * 10/1978 Nakamura ..... 24/22
4,400,855 A * 8/1983 Stuart ..... 24/200
4,685,315 A * 8/1987 Comolli ..... 70/68
4,784,286 A * 11/1988 Dahrendorf et al. ..... 220/324
6,415,786 B1 7/2002 Kolbe et al.

FOREIGN PATENT DOCUMENTS

DE 8716871 U1 2/1988
DE 36 39 421 C2 5/1988
DE 42 39 766 C2 6/1994
DE 9410354 U1 9/1994
DE 199 42 850 C1 2/2001

* cited by examiner

*Primary Examiner* — Mickey Yu
*Assistant Examiner* — Jenine Pagan
(74) *Attorney, Agent, or Firm* — McGlew and Tuttle, P.C.

(57) ABSTRACT

A closing device is provided for a container of a respirator with two container shells (2, 2') joining each other at front surfaces, with at least one tightening strap (4), which encloses a part of a container shell outer surface located at right angles to the front surfaces. Two holding elements (5, 5') are each provided with a recess (6, 6') and are formed at the free ends of the tightening strap (4). A closing element (7) is formed in a U-shaped pattern with two legs (8) and meshes with each recess (6, 6') of the holding elements (5, 5'). The legs (8) of the closing element (7) can be pulled out of the recess (6, 6') of the holding elements (5, 5') to take off the tightening strap (4).

14 Claims, 3 Drawing Sheets

RESPIRATOR

CROSS REFERENCE TO RELATED APPLICATIONS

This application claims the benefit of priority under 35 U.S.C. §119 of German Patent Application DE 10 2006 059 339.1 filed Dec. 15, 2006 and DE 10 2007 038 598.8 filed Aug. 16, 2007, the entire contents of which are incorporated herein by reference.

FIELD OF THE INVENTION

The present invention relates to a respirator with at least two container shells joining each other at front surfaces and with a closing device for holding together the container shells.

BACKGROUND OF THE INVENTION

A respirator with a closing device for closing a stand-by container composed of two identical container shells, in which the shells are held together by tightening straps arranged in a star-shaped pattern, is known from DE 36 39 421 C2. The closing device proposed has a very complicated design to attain a constant pressing pressure on a sealing ring lying between the front surfaces of the container shells.

A respirator of the type, in which dogs arranged at the ends of a tightening strap are held together by a lever, wherein the dogs snap into corresponding windows at the lever, is known from DE 42 39 766 C2 (see also corresponding U.S. Pat. No. 5,450,844 hereby incorporated by reference). Even though such a closure is satisfactory in terms of the sealing function, its mechanical design is highly complicated and its manufacture is expensive.

A respirator, comprising two container shells, is known from DE 199 42 850 C1 (see also corresponding U.S. Pat. No. 6,415,786 hereby incorporated by reference), wherein one container shell is provided with a strap mounted in two opposite fulcrum points and the strap is provided with a lever, which is used to open the two container shells. The closing device is especially suitable for containers that are mounted on a wall and which remain on the wall when the respirators are removed. Such closing devices are not optimally suitable for containers that are intended for mobile use.

SUMMARY OF THE INVENTION

The basic object of the present invention is to improve a respirator of the type such that the containers to be closed are well suited for mobile use and easy opening of the containers is made possible at the same time.

This object is accomplished according to the present invention by a respirator with at least two container shells joining each other at front surfaces and a closing device for holding together the container shells with at least one tightening strap, which encloses a part of a container shell outer surface located at right angles to the front surfaces, two holding elements, which are provided with a recess each and are provided at the free ends of the at least one tightening strap, a closing element, which has a U-shaped design with two legs and meshes with each recess of the holding elements, wherein the legs of the closing element can be pulled out of the recess of the holding elements to take off the tightening strap.

The legs of the closing element are caused to mesh with the recesses of the holding elements in the closed state of the container shells. The container is opened by pulling the two legs out of the recesses of the holding elements.

An essential advantage of the present invention compared to the state of the art is that the respirator according to the present invention is well suited for mobile use because of the small overall size of the closing device and that opening takes place with the application of a relatively weak force by pulling the closing element out of the recesses of the holding elements.

Another advantage achieved with the present invention is that the respirator according to the present invention and especially the closing device can be manufactured in a very cost-effective manner.

The respirator according to the present invention is preferably designed such that the two holding elements are designed as a loop each of the particular free ends of the at least one tightening strap.

The closing device of the respirator according to the present invention may have, furthermore, holding elements, which all have a one-part design, wherein the recess of the holding elements is tubular. The legs of the closing element are of a cylindrical shape. It is useful to provide the recess of the holding elements conically with an angle of preferably 1.15°, so that the two parallel legs can be easily removed from the recesses of the holding elements.

The provision of a holding device on the respirator according to the present invention of another preferred embodiment facilitates the holding of the closing device. The legs of the closing element are preferably dimensioned such that they project beyond the side edges of the recess formed in the holding elements when they mesh with the holding elements. The projecting part of the leg of the closing element can be fixed now by the holding device and secured by a lead seal.

In an especially preferred embodiment of the respirator according to the present invention, a closing cover is provided, which is connected to the closing element and is provided with a grip. The legs of the closing element are pulled out of the recess of the holding elements during the opening of the closing cover. The direction of opening of the closing cover extends in this case at right angles to the plane of the at least one tightening strap. The closing device of the container can thus be unlocked in a simple manner with both the left hand and the right hand in the hip area of a carrying person in case of mobile use.

The present invention will be explained in more detail with reference to the attached drawings, where identical structures are designated by the same reference numbers. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
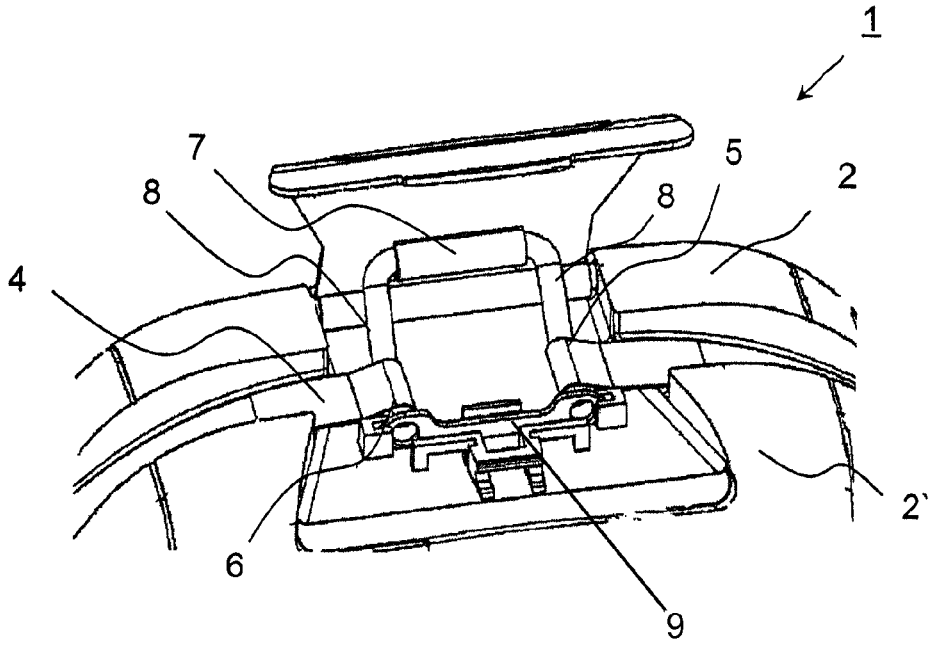
FIG. 1 is a perspective view showing a first embodiment of a closing device of the respirator according to the present invention in a nearly closed state.

Referring to the drawings in particular FIG. 1 shows a simplified view of a first embodiment of a closing device 1 of the respirator according to the present invention in a nearly closed state. The closing device 1 comprises a tightening strap 4 and two holding elements 5. The holding elements 5 are each designed as a loop at the free ends of the tightening strap 4 and thus form a recess 6. In addition, the closing device 1 comprises a closing element 7, which has a U-shaped design and has two legs 8.

The legs 8 of the closing element 7 are of a cylindrical shape and can be caused to mesh with the respective recesses 6 of the holding elements 5. In the view according to FIG. 1, the legs 8 of the closing element 7 are bent towards one another at an angle of 1.5°. This design makes possible a better fixation of the legs 8 of the closing element 7 in the particular recesses 6 of the holding elements 5. However, the legs 8 of the closing element 7 may also be parallel to one another (not shown) in another embodiment. The closing device 1 of the respirator according to the present invention as shown in FIG. 1 is shown in a nearly closed state. The legs 8 of the closing element 7 are caused to mesh with the recess 6 of the holding elements 5. The closing device 1 is opened by pulling the two legs 8 out of the recess 6 of the holding elements 5.

Figure 2:
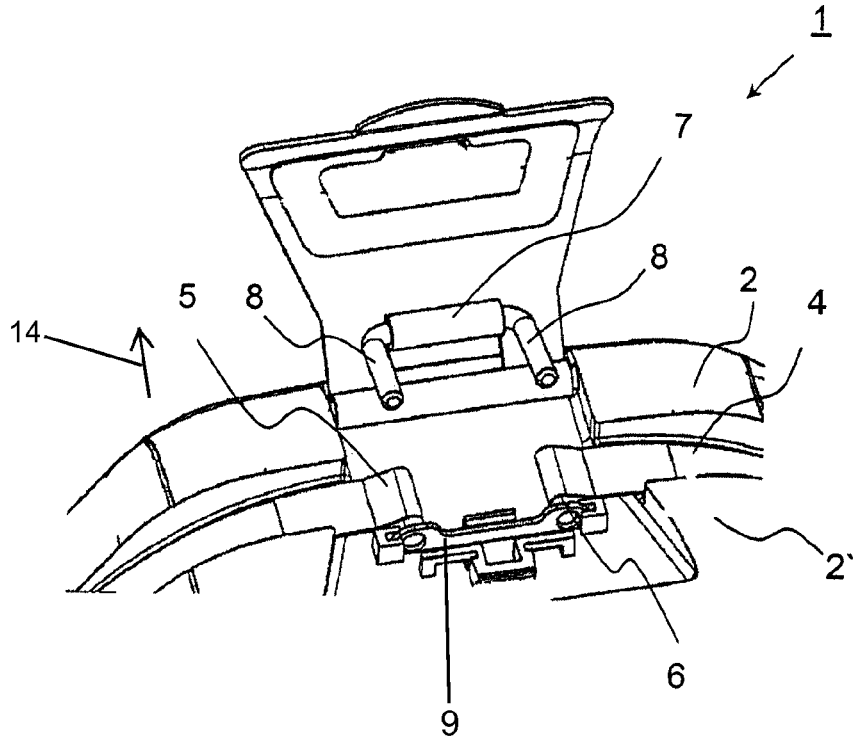
FIG. 2 is a perspective view showing the closing device of the respirator according to the present invention as shown in FIG. 1 in an opened state.

An opened state of the closing device 1 without tightening strap 4 is shown in FIG. 2.

Figure 3:
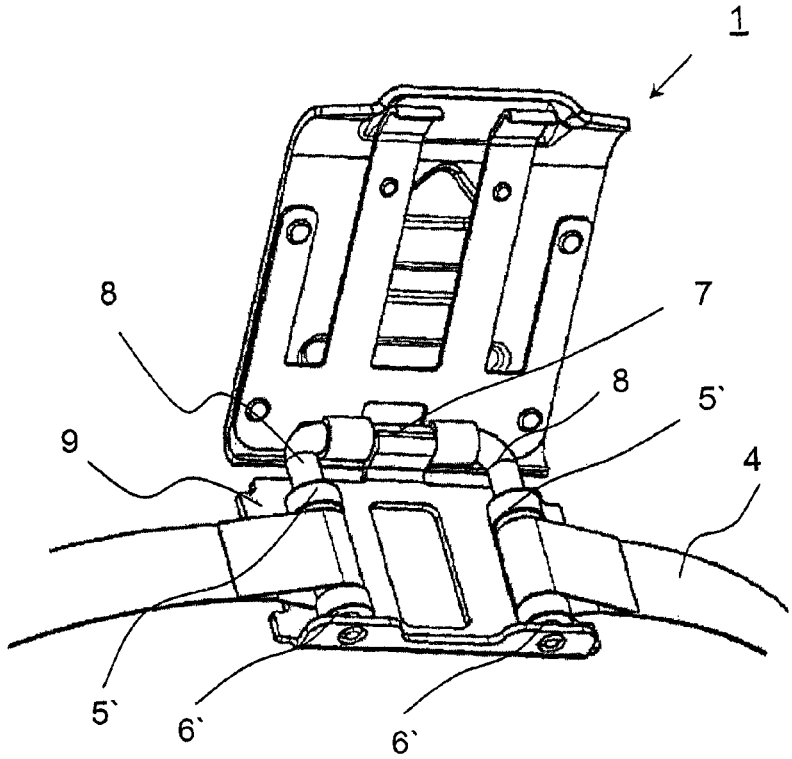
FIG. 3 is a perspective view showing a second embodiment of a closing device of the respirator according to the present invention in a nearly closed state.

FIG. 3 shows a second embodiment of the closing device 1 of the respirator according to the present invention in a nearly closed state. The closing device 1 comprises a tightening strap 4 and two holding elements 5' of a one-part design with a recess 6' each, wherein the holding elements 5' are provided at the free ends of the tightening strap 4. The ends of the tightening strap 4 advantageously surround the holding elements 5'. The recess 6' of the holding elements 5' is tubular. The closing device 1 comprises, furthermore, a closing element 7, which has a U-shaped design and has two legs 8. The legs 8 of the closing element 7 are of a cylindrical design complementary to the holding elements 5'. In another advantageous embodiment, the recess 6' of the holding elements 5' may be of a conical design, with a cone angle in the range of 1° to 2°. A cone angle of 1.15° is preferably selected. The legs 8 of the closing element 7 have, furthermore, a structure complementary to the recess 6' of the holding elements 5'. In the nearly closed state of the closing device 1 of the respirator according to the present invention as shown in FIG. 3, the closing element 7 is caused to mesh with each recess 6' of the holding elements 5'. The closing device 1 is opened in the same manner as in the case of the closing device 1 shown in FIG. 1, which was mentioned above, namely, by pulling the two parallel legs 8 out of the recess 6' of the holding elements 5'.

Figure 4:
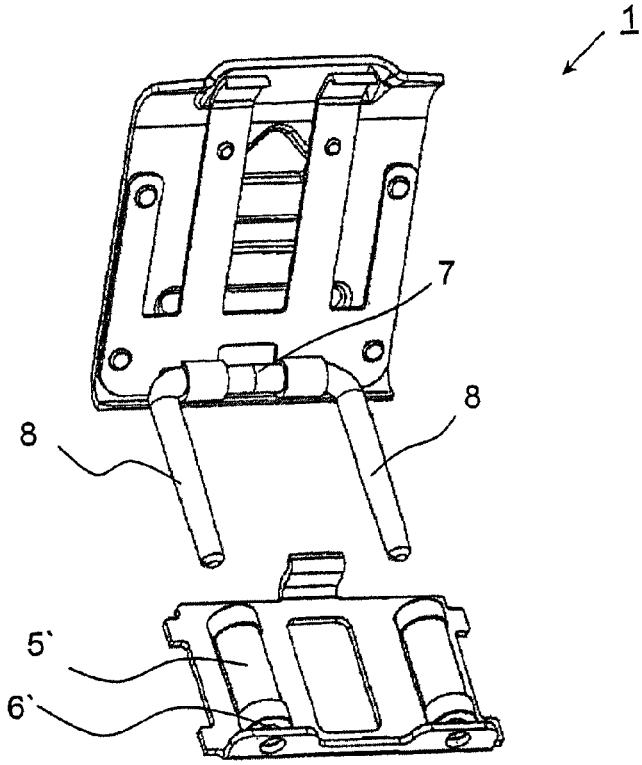
FIG. 4 is a perspective view showing a closing device of the respirator according to the present invention as shown in FIG. 3 in an opened state without tightening strap.

An opened state of the closing device 1 of the respirator according to the present invention as shown in FIG. 3 is shown in FIG. 4.

Figure 5:
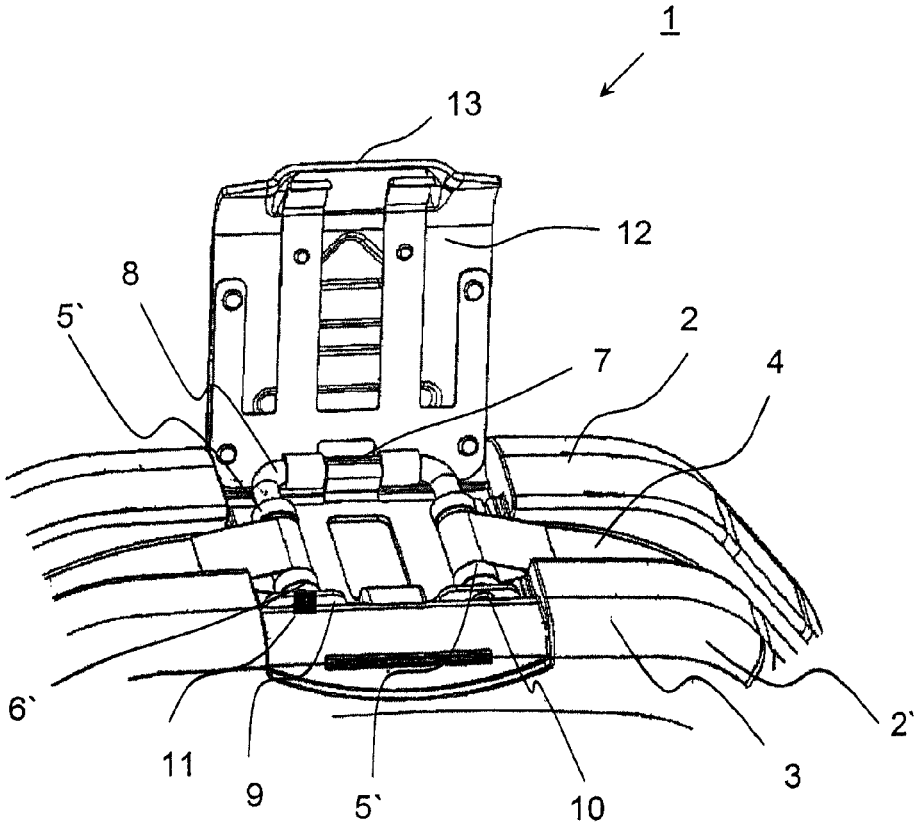
FIG. 5 is a perspective view showing the respirator according to the present invention with the closing device according to FIG. 3 in a nearly closed state.

FIG. 5 shows the respirator according to the present invention with the closing device 1 shown in FIG. 3 for the gas-tight closing of two container shells 2, 2' joining each other at front surfaces in a nearly closed state. Furthermore, a container 3 is shown, which is formed from the two container shells 2, 2' joining each other at front surfaces. The container shells 2, 2' are held together and closed with a tightening strap 4. In the tightened state, the tightening strap 4 encloses part of a container shell outer surface located at right angles to the front surfaces of the container shells 2, 2'. The container 3 of the respirator according to the present invention is used for the gas-tight closure of a respirator with a moisture-sensitive chemical oxygen carrier, which is used especially in the area of underground mining in order to make possible the reliable breathing of the user of the device in a toxic environment in case of an emergency.

The closing device 1 of the respirator according to the present invention is fixed by a holding device 9 in all five views in FIGS. 1 through 5. The holding device 9 is preferably rectangular in shape, so that it can be connected with a first angle side to the container shell 2 or 2'. Recesses 10, which are intended to receive and fix the legs 8 of the closing element 7, are formed in the second angle side of the lever device 9. The legs 8 of the closing element 7 are therefore dimensioned such that they project beyond the side edges of the recess 6, 6' formed in the holding elements 5, 5'. A lead seal 11, which is shown in FIG. 5, is preferably provided at one of the two parts of the legs 8 of the closing element 7, which said part projects beyond the side wall of the recess 6, 6' formed in the holding elements 5, 5'. The closing device 1 of the respirator according to the present invention according to FIGS. 1 through 5 is provided, furthermore, with a closing cover 12, which is connected to the closing element 7. The closing cover 12 is provided, moreover, with a grip 13. When opening the closing cover 12, the legs 8 of the closing element 7 are pulled out of the recesses 6, 6' of the holding elements 5, 5'. The direction of opening 14 of the closing cover 12 extends at right angles to the plane of the tightening strap 4. The grip 13 preferably has a large surface, so that easy opening of the closing cover 12 with protective gloves is guaranteed in emergency situations. The respirator is kept ready in the container 3 of the respirator according to the present invention by pressing together the container shells 2, 2' by means of an auxiliary device and by strapping the tightening strap 4 around part of a container shell outer surface located at right angles to the front surfaces. The holding elements 5, 5' provided at the free ends of the tightening strap 4 are caused to mesh with the legs 8 of the U-shaped closing element 7 by introducing the legs 8 into the recess 6, 6' of the holding elements 5, 5'. The closing cover 12 closes the closing device 1 in this position. The closing device 1 is fixed by the holding device 9. It is guaranteed by a locking mechanism on the closing cover 12 that the closing device 1 will not open under load (not shown).

While specific embodiments of the invention have been shown and described in detail to illustrate the application of the principles of the invention, it will be understood that the invention may be embodied otherwise without departing from such principles.

What is claimed is:

1. A respirator comprising:

two container shells joining each other at front surfaces;

a closing device for holding together said container shells, said closing device comprising:

a tightening strap enclosing part of a container shell outer surface, said part of said container shell outer surface being located at right angles to the front surfaces;

a first holding element provided with a first recess and formed at a first free end of said tightening strap;

a second holding element provided with a second recess and formed at a second free end of said tightening strap;

a U-shaped closing element with a first leg and with a second leg, said first leg engaging said first recess of said first holding element and said second leg engaging said second recess of said second holding element, wherein said first leg and second leg of said closing element can be pulled out of said recesses of said first holding element and said second holding element in a pull out direction to take off said tightening strap, said pull out direction being perpendicular to a force holding said container second free end and said first free end together;

a cover movably mounted to one of said two container shells such that said cover moves from at least a closed position to an open position in a direction perpendicular to a plane of said tightening straps, said closing element being connected to said cover, wherein said closing element moves from a first position to a second position in said pull out direction when said cover moves from said closed position to said open position;

a holding device comprising a first holding device recess and a second holding device recess, said holding device being connected to at least one of said two container shells, said legs of said closing element being dimensioned such that said legs project beyond side edges of said recess formed in said holding elements, wherein said first holding device recess receives at least a portion of said first leg and said second holding device recess receives at least a portion of said second leg with said cover in said closed position and said closing element in said first position, said legs of said closing element being located at a spaced location from said first holding device recess and said second holding device recess with said closing element in said second position and said cover in said open position.

2. A respirator in accordance with claim 1, wherein said first leg and said second leg of said closing element are bent towards one another, said first leg and said second leg being located at a spaced location from said first holding element and said second holding element with said closing element in said open position and said closing element in said second position.

3. A respirator in accordance with claim 2, wherein said first leg and said second leg of said closing element are bent towards one another at an angle having a value of 1° to 2°.

4. A respirator in accordance with claim 1, wherein said first leg of said closing element and said second leg of said closing element extend in parallel to one another, said first leg and said second leg being located at a spaced location from said first holding element and said second holding element with said closing element in said open position and said closing element in said second position.

5. A respirator in accordance with claim 4, wherein at least a portion of said closing element is located opposite an inner surface of said cover, said first leg extending through at least a portion of said first recess of said first holding element and said second leg extending through at least a portion of said second recess of said second holding element with said cover in said closed position, said first leg being located at a spaced location from said first recess and said second leg being located at a spaced location from said second recess with said cover in said open position, at least a portion of said tightening straps being parallel to said front surfaces, said two container shells defining an impermeable respirator space.

6. A respirator in accordance with claim 5, wherein said closing cover includes a grip.

7. A respirator in accordance with claim 2, wherein said first leg and said second leg are bent towards one another at an angle of about 1.5°.

8. A respirator in accordance with claim 5, wherein said tightening strap applies a first holding force to at least one of said container shells via said closing element with said cover in said closed position, said tightening strap applying a second holding force with said cover in said open position, said first holding force being greater than said second holding force.

9. A respirator comprising:

two container shells joining each other at front surfaces;

a closing device for holding together said container shells, said closing device comprising:

a tightening strap enclosing part of a container shell outer surface, said part of said container shell outer surface being located at right angles to the front surfaces;

a first holding element provided with a first recess and formed at a first free end of said tightening strap;

a second holding element provided with a second recess and formed at a second free end of said tightening strap;

a U-shaped closing element with a first leg and with a second leg, said first leg engaging said first recess of said first holding element and said second leg engaging said second recess of said second holding element, wherein said first leg and second leg of said closing element can be pulled out of said recesses of said first holding element and said second holding element in a pull out direction to take off said tightening strap, said pull out direction being perpendicular to a force holding said container second free end and said first free end together;

a cover movably mounted to one of said two container shells such that said cover moves from at least a closed position to an open position in a direction perpendicular to a plane of said tightening straps, said closing element being connected to said cover, wherein said closing element moves from a first position to a second position in said pull out direction when said cover moves from said closed position to said open position, said first leg of said closing element and said second leg of said closing element extending in parallel to one another, said first leg and said second leg being located at a spaced location from said first holding element and said second holding element with said closing element in said open position and said closing element in said second position, at least a portion of said closing element being located opposite an inner surface of said cover, said first leg extending through at least a portion of said first recess of said first holding element and said second leg extending through at least a portion of said second recess of said second holding element with said cover in said closed position, said first leg being located at a spaced location from said first recess and said second leg being located at a spaced location from said second recess with said cover in said open position, at least a portion of said tightening straps being parallel to said front surfaces, said two container shells defining an impermeable respirator space;

a holding device comprising a first holding device recess and a second holding device recess, said holding device being connected to one of said two container shells, said first holding device recess being aligned with said first recess of said first holding element and said second holding device recess being aligned with said second recess of said second holding element with at least said cover in said closed position.

10. A respirator system, comprising:

a respirator comprising a moisture-sensitive chemical oxygen carrier;

two container shells joining each other at front surfaces to form a gas impermeable respirator space, said respirator being provided in said gas impermeable respirator space;

a cover movably connected to at least one of said container shells such that said cover is movable between at least an open position and a closed position;

a closing device for holding together said container shells, said cover being connected to said closing device, said closing device comprising:

a tightening strap enclosing part of a container shell outer surface, said container shell being located at right angles to the front surfaces;

a first holding element provided with a first recess and formed at a first free end of said tightening strap;

a second holding element provided with a second recess and formed at a second free end of said tightening strap;

a U-shaped closing element with a first leg and with a second leg, said first leg engaging said first recess of said first holding element and said second leg engaging said second recess of said second holding element with said cover in said closed position such that a tightening force is applied to said tightening strap to hold said container shells together, said first leg being located at a spaced location from said first recess and said second leg being located at a spaced location from said second recess with said cover in said open position;

a holding device comprising a first holding device recess and a second holding device recess, said holding device being connected to one of said two container shells, said legs of said closing element being dimensioned such that said legs project beyond side edges of said recess formed in said holding elements with said cover in said closed position, wherein said first holding device recess receives at least a portion of said first leg and said second holding device recess receives at least a portion of said second leg with said cover in said closed position, said closing element moving in a direction perpendicular to said tightening strap when said cover moves at least between said closed position and said open position.

11. A respirator system in accordance with claim 10, wherein said first holding device recess is aligned with said first recess of said first holding element and said second holding device recess is aligned with said second recess of said second holding element with at least said cover in said closed position, said closing element moving in said direction perpendicular to said tightening strap when said cover moves from said open position to said closed position, at least a portion of said closing element being located opposite an inner surface of said cover.

12. A respirator system in accordance with claim 11, wherein said tightening strap applies a first holding force via said closing element with said cover in said closed position such that a vertical force is applied to said two container shell, said tightening strap comprising a second holding force with said cover in said open position, said first holding force being greater than said second holding force.

13. A respirator system in accordance with claim 10, wherein at least a portion of said tightening strap extends in a direction parallel to said front surfaces.

14. A respirator system, comprising:

a respirator;

a first container shell comprising a first container shell front surface;

a second container shell comprising a second container shell front surface, said first container shell and said second container shell defining an impermeable respirator space, said respirator being provided in said impermeable respirator space;

a cover movably connected to one of said container shells such that said cover is movable between at least an open position and a closed position;

a closing device for holding together said container shells, said cover being connected to said closing device, said closing device comprising:

a tightening strap, said first container shell and said second container shell being joined at said first container shell front surface and said second container shell front surface via said tightening strap with said cover in said closed position, said first container shell and said second container shell defining an outer container shell surface, said outer container shell surface being orthogonal to said first container shell front surface and said second container said second holding device recess being aligned with said second recess of said second holding element with at least said cover in said closed position, said legs of said closing element being dimensioned such that said legs project beyond side edges of said recess formed in said holding elements with said cover in said closed position, wherein said first holding device recess receives at least a portion of said first leg and said second holding device recess receives at least a portion of said second leg with said cover in said closed position, said tightening strap applying a first holding force via said closing element with said cover in said closed position to hold said first container shell and said second container shell together, said tightening strap comprising a second holding force with said cover in said open position, said first holding force being greater than said second holding force, at least a portion of said closing element being located opposite an inner surface of said cover.

* * * * *